United States Patent [19]

Brock

[11] 4,030,748

[45] June 21, 1977

[54] SUN SHADE APPARATUS

[76] Inventor: Helmut E. Brock, 551 Loughlin Road R.D. 6, Binghamton, N.Y. 13904

[22] Filed: Oct. 7, 1975

[21] Appl. No.: 620,383

[52] U.S. Cl. ..... 297/184; 135/5 R; 248/230

[51] Int. Cl.[2] ..... A47C 7/66

[58] Field of Search ..... 297/184, 29; 5/362; 135/5; 248/230, 221 F, 221 R

[56] References Cited

UNITED STATES PATENTS

| | | | |
|---|---|---|---|
| 585,269 | 6/1897 | Hesse | 248/230 |
| 2,718,006 | 9/1955 | Bowers | 2/10 |
| 2,747,653 | 5/1956 | Obradovich | 297/29 |
| 2,752,929 | 7/1956 | Berger | 135/5 R |
| 3,005,614 | 10/1961 | Daniell | 248/230 |
| 3,237,203 | 3/1966 | Nielsen | 2/10 |
| 3,241,160 | 3/1966 | Escobar | 297/184 X |
| 3,370,820 | 2/1968 | Liss et al. | 248/230 |
| 3,738,703 | 6/1973 | Kunimatu | 297/184 |

FOREIGN PATENTS OR APPLICATIONS

| | | | |
|---|---|---|---|
| 287,516 | 12/1952 | Switzerland | 297/184 |

*Primary Examiner*—Roy D. Frazier
*Assistant Examiner*—Darrell Marquette

[57] ABSTRACT

A sun shade for use on lounge chairs comprises an elongated strip of flexible plastic having a pair of brackets adjustably pivotably affixed to ends of the sheet, each of the brackets being adjustably positionable along a respective side portion of a conventional lounge chair.

2 Claims, 7 Drawing Figures

SUN SHADE APPARATUS

Figure 1:
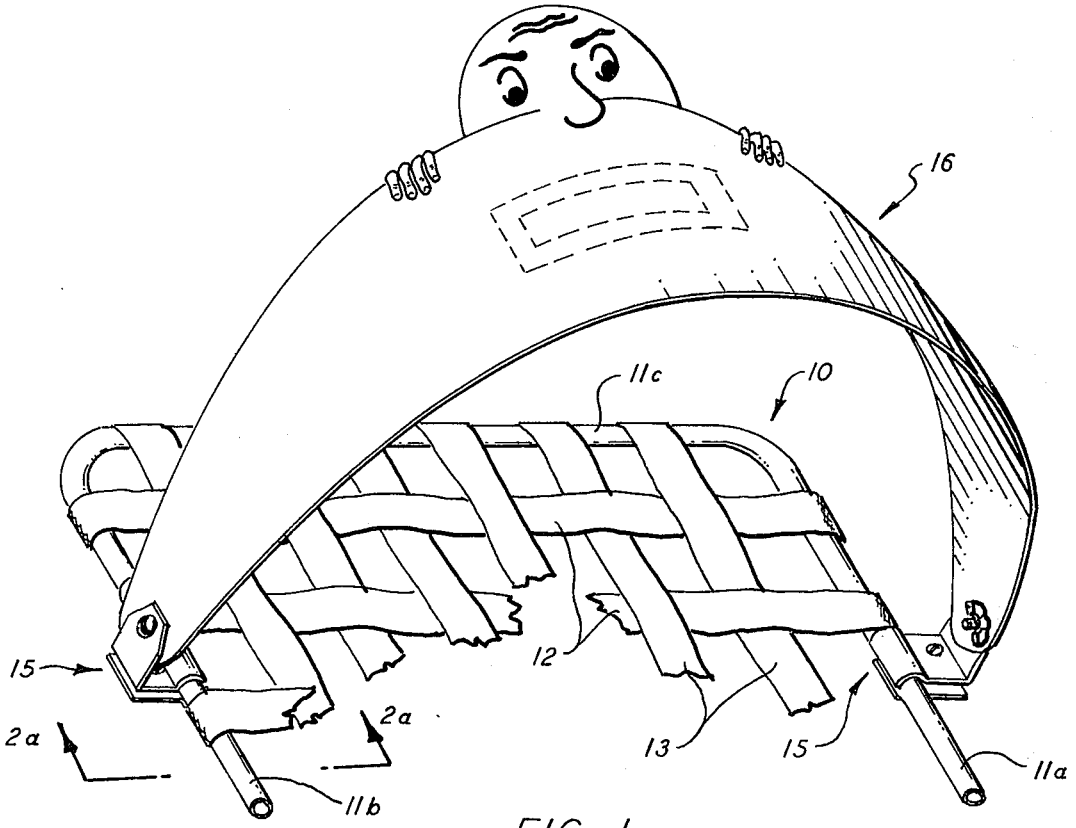

My invention relates to a sun shade which may be used with a wide variety of convenional beach, deck or lounge chairs. The idea of providing sun shades which attach to such chairs is old and well-known, and shown, for example, in U.S. Pat. Nos. 2,747,653 and 2,752,929. One object of the present invention is to overcome a number of disadvantages of prior art sun shades.

The position to which the user may desire to adjust a shade on such a chair may vary considerably under different conditions. Many lounge chairs are made adjustable, so that one end portion can be positioned either semi-erect to function as a back-rest to support a person in a sitting position, or instead positioned horizontally to support the occupant in a reclining position, and some chairs are adjustable to various intermediate positions. The desired position of a sun shade often varies depending upon whether the occupant is sitting or reclining. The desired position often varies in accordance with the time of day, as the sun sets or rises. The desired position also may vary in accordance with the nature of the occupant's activity, with the shade being positioned to protect one's eyes from glare while reading, for example, or in a second position to allow one's face to tan without sunburning one's bald head, or in a third position should a woman wish to avoid sunburn of her bare midriff. Various sun shades heretofore proposed for use in lounge, deck, or beach chairs are incapable of ready adjustment to the many different positions which a user often would find desirable, and one important object of the present invention is to provide an improved sun shade assembly for such chairs which is readily positionable to a greater variety of positions than shades associated with prior chairs.

Various sun shades which have been proposed for use on such chairs are expensive to construct, and one important object of the present invention is to provide an improved sun shade which may be fabricated and assembled extremely economically. Some sun shades heretofore proposed for use on such chairs may be readily fabricated and assembled in a factory, but they require drilling or similar modificaton of chair members, rendering them unsuitable for easy installation on existing chairs, and one object of the present invention is to provide an improved sun shade assembly which may be readily installed by a user on most such chairs without the need for drilling or similar operations. A further object of the invention is to provide a sunshade assembly which may be readily installed on any of a group of chairs having various widths.

Some sun shades heretofore proposed are only adjustable to a few discrete angular positions over a limited angular range, and one important object of the invention is to provide an improved sun shade assembly which is continuously adjustable, and adjustable over a greater range of angular postions. The adjustment of some prior sun shades to angles required to block radiation sometimes located such a shade undesirably near the user's face, interfering with or impeding a user activity such as eating, drinking, smoking or reading. Another object of the invention is to provide an improved sun shade assembly in which the shade may be adjusted through a large angular range yet remain a substantially constant distance from the user's face. Another object of the present invention is to provide a sun shade which may be adjusted rapidly and easily, using only one hand, and without a need for mechanical dexterity. A further object of the invention is to provide a sun shade which is not readily susceptible to damage from wind, rain, or user mis-handling.

Other objects of the invention will in part be obvious and will in part appear hereinafter.

The invention accordingly comprises the features of construction, combination of elements, and arrangements of parts, which will be exemplified in the construction hereinafter set forth, and the scope of the invention will be indicated in the claims.

For a fuller understanding of the nature and objects of the invention reference should be had to the following detailed description taken in connection with the accompanying drawings, in which:

FIG. 1 is an isometric view of a preferred form of the sun shade assembly of the present invention, showing the assembly installed on a conventional lounge chair, only a portion of which chair is shown in FIG. 1.

Figure 2A:
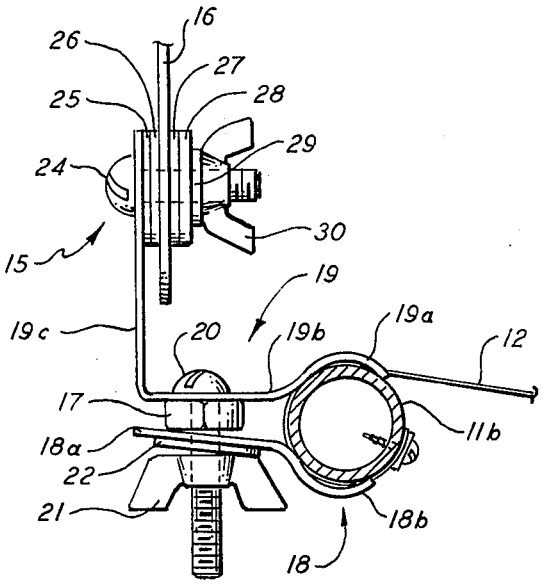

FIG. 2*a* is a cross-section elevation view taken at lines 2*a*—2*a* in FIG. 1 and illustrating in detail a clamping means portion of the assembly of FIG. 1.

Figure 2B:
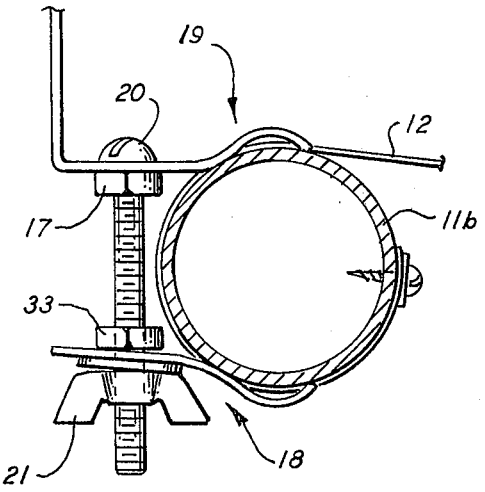
Figure 2C:
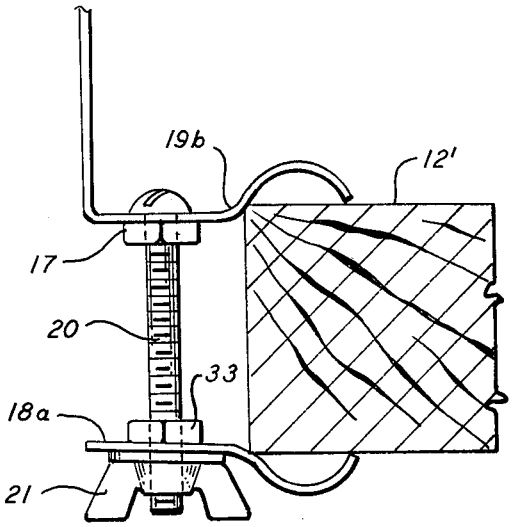

FIGS. 2*b* and 2*c* are elevation views similar to FIG. 2*a* showing the clamping means installed on several different forms of chair side members.

Figure 3:
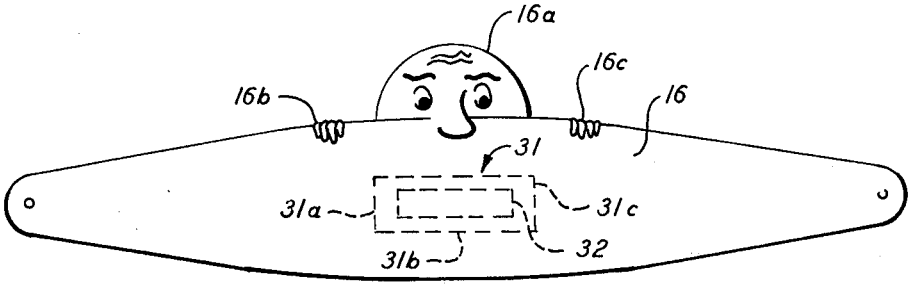

FIG. 3 is a plan view showing, in flattened form, a semi-flexible plastic sheet portion of the assembly of FIG. 1.

Figure 4A:
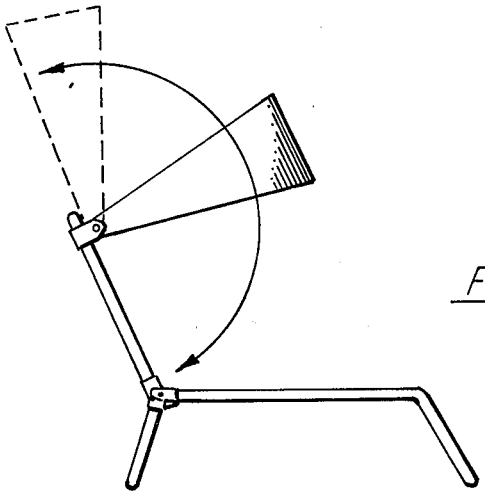
Figure 4B:
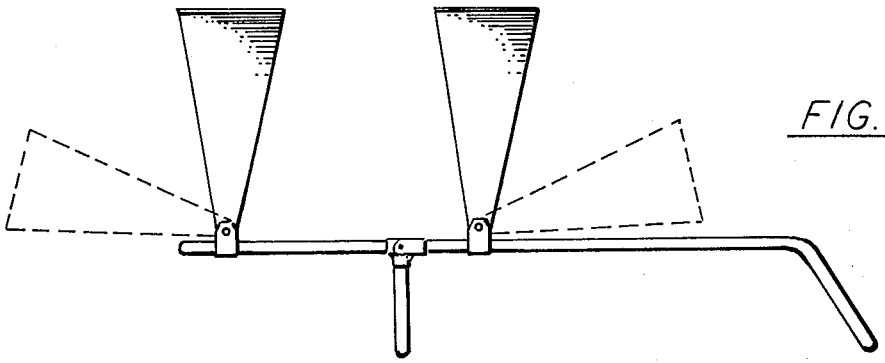

FIGS. 4*a* and 4*b* are side elevation views illustrating installation of a clamping means of the sun shade assembly in several different places on chair side members.

Referring now to FIG. 1 a back portion 10 of a conventional lounge chair is shown as comprising a bent piece of hollow tubing 11 having lateral strips 12, 12 and longitudinal strips 13, 13 of plastic or cloth webbing stretched thereacross. While denominated the "back" portion of a chair, it is to be understood that portion 10 may be, and ordinarily will be, adjustable between and lockable in either a substantially vertical position or a substantially horizontal position, or positions therebetween using any of the variety of techniques conventionally used in the chair art for such purposes. It is in no sense necessary that the chair back be adjustable, however. As will be seen below the sun shade assembly can instead be installed on a bottom or seat portion of a chair rather than on a back portion. While chair portion 10 is shown in FIG. 1 as utilizing a single piece of tubing 11 having three sections to form two longitudinally-extending frame sections 11*a*, 11*b* joined by a laterally-extending end frame section 11*c*, various conventional chairs will instead use different types of longitudinal and laterally-extending members. A large majority of such chairs include a pair of tubular, parallel, spaced-apart longitudinally-extending members similar to those provided by tubing 11 at 11*a* and 11*b*, which results in a ready installation of the sun shade assembly on a large percentage of existing lounge chairs. However, it is by no means essential that a chair include tubular members, and as will become clear below, the improved shade assembly may be readily attached to chairs having a single back member such as a flat board, and irrespective of whether the chair members are covered with webbing. The sun shade assembly actually can be clamped on a wide variety of standard household and office chairs, although it is contemplated that it will primarily be used with conventional lounge, deck or beach chairs.

The sun shade assembly of the present invention comprises a pair of clamping means 15, 15 which clamp to respective sides of the chair, and a semi-flexible plastic sheet 16 which extends between the pairs of clamping members. Sheet 16, which may comprise a vinyl sheet of uniform thickness, may have a flat or relaxed shape of the type shown in FIG. 3. The length of sheet 16 exceeds the distance between side members 11*a*, 11*b*, and hence upon installation of the assembly, sheet 16 becomes bowed out to assume the arcuate shape shown in FIG. 1. In a typical embodiment of the invention the length of sheet 16 between its two mounting holes may be of the order of 48 inches where side members 11*a*; 11*b* of the chair are roughly 20 inches apart. Because sheet 16 is flexible it will become apparent that use of a given assembly on different chairs having different spacings between their side frame members will result in slightly differing arcuate radii, but that any need to tailor the assembly for a specific side member spacing is obviated for a wide range of chair widths.

As best seen in FIG. 2*a*, each clamping means 15 comprises a lower plate 18 having a flat portion 18*a*, a semi-cylindrical groove or depression 18*b*, and an upper plate 19 having a semi-cylindrical groove 19*a*, a flat intermediate portion 19*b* and a upstanding arm or tab portion 19*c*. Carriage bolt 20 extends through nut 17, and through registering holes in plate members 18 and 19, and by tightening wing nut 21 against flat washer 22, plate members 18 and 19 are clamped in position on the tubular chair frame side member 11*a* or 11*b*. In FIG. 2*a* a strip of plastic webbing 12 is shown looped partially around and fastened to the side member 11*b* by means of a screw. A square hole is preferably provided in plate 19 to receive the square shoulder of carriage bolt 20, and thus each clamping means 15 may be readily tightened or loosened without need for a screwdriver. A lockwasher (not shown) may be used between wing nut 21 and washer 22, if desired. Nut 17 acts as a spacer, and when the clamping means is installed on some sizes of chair side members, nut 17 may be omitted.

Carriage bolt 24 extends horizontally through a square hole in plate member 19, through steel flat-washer 25, flat rubber washer 26, through a round hole near an end of plastic sheet 16, and through rubber washer 27, steel flat washer 28, and spring lock-washer 29 to engage wing nut 30 so that tightening wing nut 30 clamps sheet 16 to the upstanding portion 19*c* of the upper clamping plate 19 between rubber washers 26 and 27. With the wing nuts 30 of the two clamping means "finger tight", the bowed sheet 16 will be frictionally held in a selected angular position about an axis defined by the two carriage bolts 24 of the two clamping means 15, but by merely pushing on sheet 16, with only one hand, the user may re-position the sheet to any one of a variety of other angular positions about that axis.

While the two clamping means 15 are installed on opposite sides of a chair, it will be seen that the two need not be fabricated in left hand and right hand pairs, but instead may be identical, thereby affording significant economy of fabrication. It will be apparent that members 18 and 19 may be formed extremely inexpensively, preferably from galvanized or otherwise coated sheet steel stock.

Sheet 16 preferably comprises a semi-flexible plastic sheet, such as vinyl sheet-approximately 0.040 inch thick, which may be readily stamped or otherwise sheared to desired dimensions. The ends of the sheet are preferably rounded as shown, to avoid the presentation of corners upon which a user could scratch himself. The sheet is shown tapering from a maximum width near its center to a narrower width at each end. This arrangement, together wih location of each bolt 24 spaced upwardly from the lower portions 19*a*, 19*b* of each clamping means, will be seen to allow the sheet to be pivoted through a large angular range approaching 180°, without edges of the sheet being stopped by either clamping means 15. Sheet 16 is shown as including central projecting portions 16*a*, 16*b* and 16*c* simulating portions of the head and hands of a gnome, with indicia painted or otherwise affixed to those portions. Such projections and indicia may be omitted, of course, without departing from the invention.

Convenience in use of the sun shade is greatly facilitated by use of the rubber washers 26 and 27 on each clamping means to engage opposite sides of vinyl sheet 16, as this allows the sheet 16 to be readily adjusted to any desired angle by merely pushing on it, without a need to loosen and then re-tighten any bolts or nuts. It has been found that with the wing nuts 30 of the two clamping means tightened just finger tight, to a degree which they may be easily tightened even by women and many children, sheet 16 may be adjusted very many times to successive different angular positions without any need to re-tighten those wing-nuts, and importantly, without wear of sheet 16. As the shade 16 is angularly adjusted, washers 25 to 29, bolt 24 and nut 30 all rotate together with the sheet 16, and thus the plastic sheet does not experience wear. The rubber washers frictionally engage the sheet 16 so as to hold the sheet in any desired position, even in a horizontal or cantilever type position, and even in the presence of substantial wind. While washers 26 and 27 have been denominated as rubber, it will be apparent that equivalent elastomeric washers may be used.

The horseplay which occurs around swimming pools or on beaches and in some other places where lounge chairs are used can result in serious injury if persons fall against some prior sun shade assemblies. However, because sheet 16 is semi-flexible and readily pivotable if appreciably pushed, the danger of a person who falls against the assembly being injured is greatly reduced in comparison to prior sun shade assemblies having elongated metal rods or the like.

As shown in dashed lines in FIGS. 1 and 3, the underside of sheet 16 may carry a sheet of fabric 31, which may be cemented or otherwide affixed to sheet 16 on three sides, as at 31*a*, 31*b*, 31*c*, to form a pocket, in which a user may store various articles within easy reach, and a conventional mirror 32 may be cemented or otherwise carried on the fabric. Because the mirror is carried on a flexible piece of fabric, it may be flat, even though sheet 16 may be bowed in an arcuate shape.

It will be readily appreciated from FIG. 2*a* that each clamping means 15 can be readily clamped so that its two depressions 19*a* and 18*b* surround and grip a cylindrical side member of a chair at places where webbing or the like is not looped around the side member. However, an important feature of the invention is that clamping means 15, 15 are readily clampable on the sides of chairs around which webbing is looped, on the sides of chairs having a variety of different sizes of side members, and on chairs having rectangular and other types of side members. In FIG. 2*b* side member 11*b* of a chair is shown having a substantially greater diameter than in FIG. 2*a*, but the same clamping means is still readily installable, by the mere addition of further nut 33. Nuts 17 and 33 will be seen to function as a spacer of adjustable length, which mainstains clamp members 18 and 19 a desired distance apart as wing nut 21 is tightened. In FIG. 2*c* the clamping means is shown installed on the edge of a wooden chair slat 12'. Nuts 17 and 33 will be seen to tend to maintain the flat portions 18*a* and 19*b* parallel to each other. It will be readily apparent that the clamping means can be easily installed on slats of lesser thickness by merely moving nut 33 upwardly on bolt 20. It will become apparent upon reflection that the clamping means are also readily installable on even further shapes of chair side members.

In FIG. 4*a*, wherein the assembly is shown clamped to the back of a chair, it will be apparent that the assembly is readily positionable through the angular range indicated by the arrow, and as the shade is positioned to various angular positions, it will be apparent that it will remain substantially the same distance from the head of a person (not shown) seated on the chair. In FIG. 4*b* the shade assembly is shown in dashed lines at a variety of different positions. Because the clamping means can readily clamp at any desired position along the length of the bottom or seat portion of most recreational chairs, it will be apparent that the assembly has great utility and may be adapted to block radiation from a wide variety of different angles.

Members 18 and 19 of each clamping means are preferably made of galvanized steel sheet, although they may be made of plastic.

It will thus be seen that the objects set forth above, among those made apparent from the preceding description, are efficiently attained, and since certain changes may be made in the above construction without departing from the scope of the invention, it is intended that all matter contained in the above description or shown in the accompanying drawings shall be interpreted as illustrative and not in a limiting sense.

The embodiments of the invention in which an exclusive property or privilege is claimed are defined as follows:

1. A sun shade assembly for attachment to a chair having a pair of generally parallel side frame members spaced apart on opposite sides of the chair, comprising, in combination: first and second clamping means for mounting at a plurality of desired positions along respective ones of said side frame portions, each of said clamping means comprising an upper and a lower plate member and means for bolting said upper and lower members together with a respective one of said side frame portions of said chair clamped therebetween, said upper plate member having an upstanding tab portion having a bolt hole; and an elongated semi-flexible plastic sheet extending between and having its ends pivotally attached to and frictionally engaged by respective ones of said clamping means, the length of said plastic sheet member exceeding the distance between said side frame portions of said chair whereby said plastic sheet member is held bowed in a generally arcuate shape, each end of said plastic sheet member being bolted to the upper member of a respective one of said clamping means by means of a bolt passing through said bolt hole and the end of said plastic sheet member, and compressible washer means carried on each said bolt between each upstanding tab portion and the end of said plastic sheet member, said plastic sheet member having a central portion of greater width than said ends of said plastic sheet member.

2. The assembly according to claim 1 having a rectangular piece of flexible fabric, three edges of said piece of fabric being affixed to said plastic sheet member to form a pocket, and a rigid mirror carried on said piece of flexible fabric.

* * * * *